US006929400B2

(12) United States Patent
Razeti et al.

(10) Patent No.: US 6,929,400 B2
(45) Date of Patent: Aug. 16, 2005

(54) FLEXIBLE RECLOSABLE CONTAINER WITH EASY OPENING

(75) Inventors: Marco Razeti, Padova-Località Mandria (IT); Elena Peron, Schio (IT); Michael Ellenrieder, Augsburg (DE)

(73) Assignee: BP Europack S.p.A. (IT)

( * ) Notice: Subject to any disclaimer, the term of this patent is extended or adjusted under 35 U.S.C. 154(b) by 273 days.

(21) Appl. No.: 10/444,275

(22) Filed: May 23, 2003

(65) Prior Publication Data

US 2003/0223656 A1 Dec. 4, 2003

(30) Foreign Application Priority Data

May 28, 2002 (IT) ..... PD2002A0141

(51) Int. Cl.[7] ..... B65D 33/16

(52) U.S. Cl. ..... 383/66; 383/203; 383/207; 383/211; 229/87.05

(58) Field of Search ..... 383/66, 203–204, 383/207, 210–211; 229/87.05

(56) References Cited

U.S. PATENT DOCUMENTS 3,249,288 A * 5/1966 Repko ..... 383/204
3,313,473 A * 4/1967 Witters ..... 229/80
3,570,751 A * 3/1971 Trewella ..... 383/207
4,026,131 A * 5/1977 Dugger et al. ..... 68/17 A
4,192,420 A * 3/1980 Worrell et al. ..... 206/205
4,260,061 A * 4/1981 Jacobs ..... 383/203
4,428,477 A 1/1984 Cristofolo
4,572,377 A * 2/1986 Beckett ..... 383/5
5,409,115 A 4/1995 Barkhorn
5,855,435 A 1/1999 Chiesa
5,945,145 A 8/1999 Narsutis et al.
6,415,939 B1 * 7/2002 Redmond ..... 220/266

FOREIGN PATENT DOCUMENTS

EP 0 298 054 4/1989

* cited by examiner

*Primary Examiner*—Jes F. Pascua
(74) *Attorney, Agent, or Firm*—Kudirka & Jobse LLP

(57) ABSTRACT

A flexible container of the pouch type, made of material in film form, derived from a contoured tubular body formed by a film with longitudinal and transverse heat-seals of the two ends. The longitudinal heat-seal forms the edge of a longitudinal wing that is folded against the corresponding wall. A portion of the wing is joined to a corresponding portion of the wall with low-tack adhesive so as to surround a region preset to form a hole for access to the container, the first lifting of the wing opening the hole and the container, and the low-tack adhesive ensuring successive repeated opening and closure actions.

7 Claims, 2 Drawing Sheets

FLEXIBLE RECLOSABLE CONTAINER WITH EASY OPENING

BACKGROUND OF THE INVENTION

The present invention relates to a flexible container.

The container is of the "pouch" type, made of material in film form, and is particularly but not exclusively suited for containing food products such as candy, chocolates, confectionery, et cetera.

It can in fact be used also to contain other kinds of product, including non-food products.

As is known, the flexible containers of many food products such as many kinds of candy and chocolates (each of which is usually already packaged individually) or certain kinds of confectionery, but also certain kinds of candy and chocolates (not packaged individually) are made of material in film form, for example polypropylene, and are derived from a suitably shaped tubular element that forms faces and sides with folds formed by means of a longitudinal heat-seal and by transverse heat-seals of the two ends.

Due to their shape, these containers are commonly termed "pouches".

Packaging occurs by placing two flaps of the film mutually adjacent and heat-sealing them, so as to form a continuous tubular element which, filled with the product to be preserved, is heat-sealed transversely and cut appropriately so as to separate the top heat-seal of one container from the bottom heat-seal of the next container.

Said flexible containers are manufactured so that the user can open them in order to access the products as simply and effectively as possible and to avoid (as sometimes occurs) having to force the package, because one is unable to open it with a simple operation.

Moreover, it is desirable for the container not to open completely, but open only partially, so that the user, for example, can remove only some of the products and said container can continue to perform its containment functions for the unused products.

Therefore, the need is strongly felt to be able to reclose the container so as to prevent its contents from scattering.

SUMMARY OF THE INVENTION

The aim of the present invention is to provide a flexible container for products, provided starting from a film by means of heat-seals, that can be opened easily and then reclosed in order to retain inside it the unused products.

Within this aim, an object of the present invention is to provide a flexible reclosable container with easy opening that can be manufactured by means of automated systems.

Another object of the present invention is to provide a flexible reclosable container with easy opening, that can be manufactured with low production costs.

This aim and these and other objects that will become better apparent hereinafter are achieved by a flexible container of the type derived from a contoured tubular body formed by a film by means of a longitudinal heat-seal and of transverse heat-seals of the two ends, said container being characterized in that said longitudinal heat-seal forms the edge of a longitudinal wing that is folded against the corresponding wall, a portion of the wing being joined to a corresponding portion of the wall by means of a low-tack adhesive so as to surround a region preset to form a hole for access to the container, the first lifting of the wing opening said hole and therefore the container, said low-tack adhesive ensuring successive repeated opening and closure actions.

BRIEF DESCRIPTION OF THE DRAWINGS

Further characteristics and advantages of the invention will become better apparent from the following detailed description of two embodiments thereof, illustrated only by way of non-limitative example in the accompanying drawings, wherein.

DESCRIPTION OF THE PREFERRED EMBODIMENTS

Figure 1:
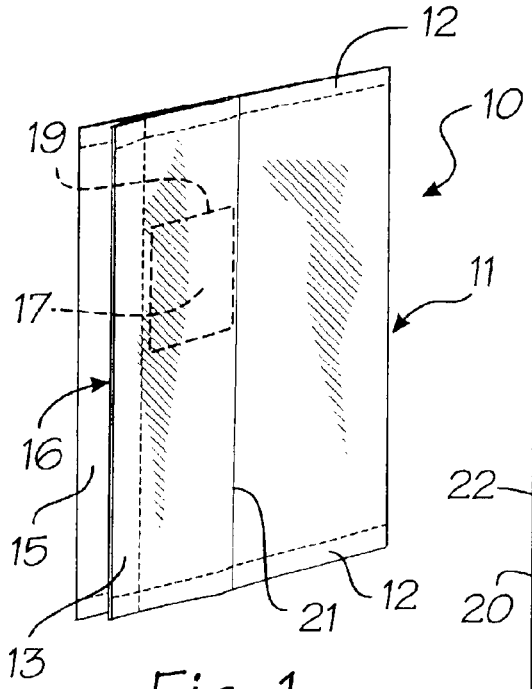
FIG. 1 is a perspective view of a container according to the invention in the closed configuration.
Figure 3:
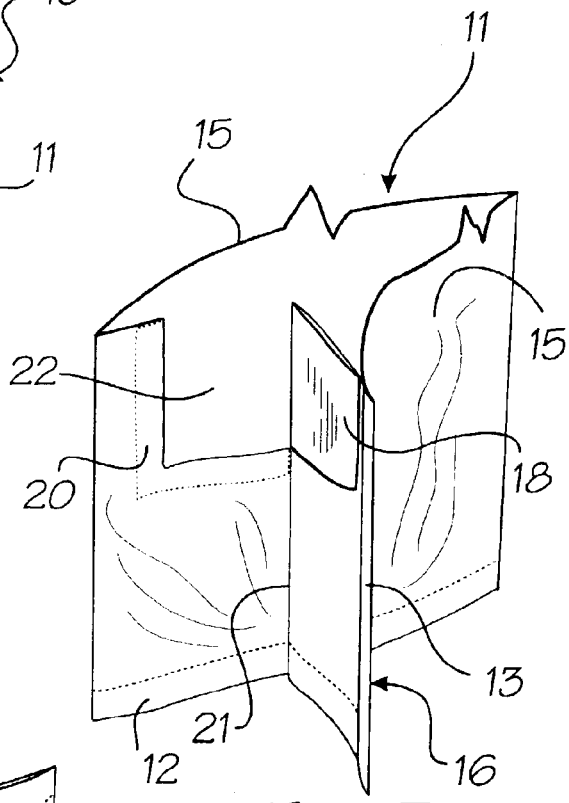
FIG. 3 is a sectional perspective view of a lower part of the container of FIG. 1, in the open configuration.
Figure 2:
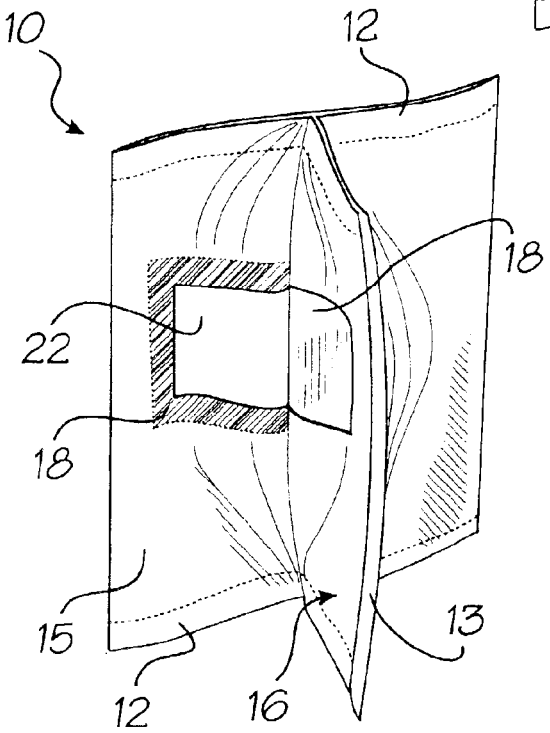
FIG. 2 is a perspective view of the container of FIG. 1, in the open configuration.
Figure 4:
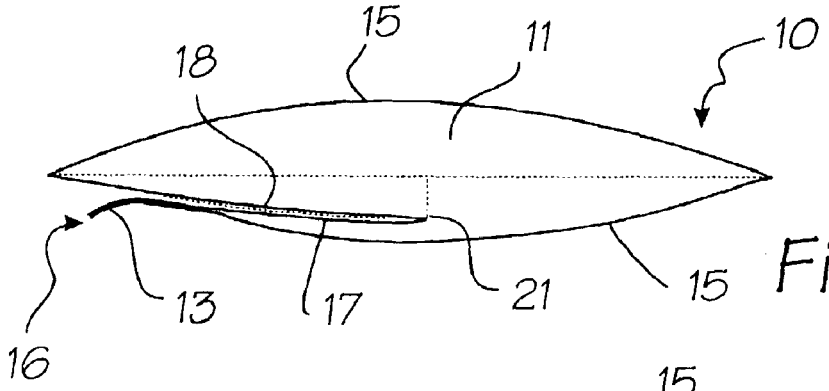
FIG. 4 is a sectional view of the container in the configuration of FIG. 1.
Figure 5:
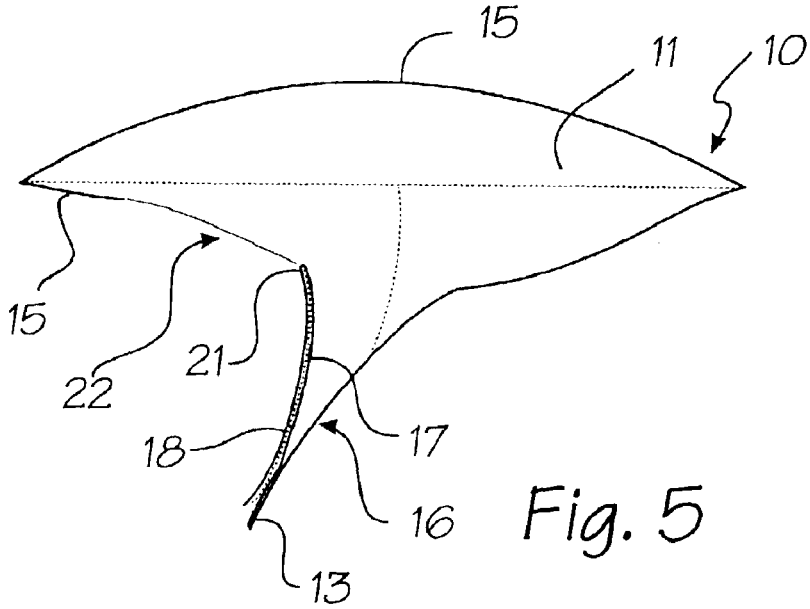
FIG. 5 is a sectional view of the container in the configuration of FIG. 2.
Figure 6:
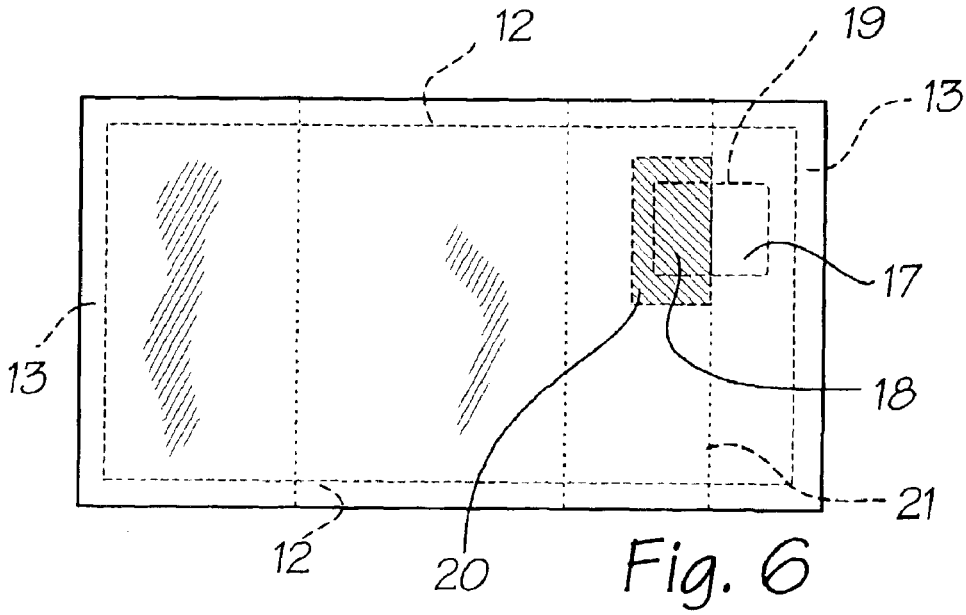
FIG. 6 is a view of the container according to the invention in the opened-out configuration.

With reference to the figures, a flexible reclosable container with easy opening is generally designated by the reference numeral 10 and is obtained starting from a film that forms a tubular body 11, inside which products are accommodated and on which transverse heat-seals 12 are formed at the two ends.

Said film, generally wound in rolls, is unwound and folded so as to form a continuous tubular body by means of a longitudinal heat-seal 13; transverse cuts and heat-seals 12 then form the body 11, on which two mutually facing walls 15 can be identified.

The longitudinal heat-seal 13 is obtained substantially at the longitudinal central region, in this case, of a wall 15.

According to the invention, the longitudinal heat-seal 13 forms the edge of a longitudinal wing 16 that is folded against the corresponding wall 15.

In this case, the heat-seal 13 affects only, i.e. extends over, the outermost region of the wing 16.

A portion 17 of said wing 16 is coupled by means of adhesive or heat-sealing or similar means to a corresponding portion or region 18 of the wall, which in this case has a substantially quadrangular contour, and is surrounded on three sides by a prescoring line 19, on the outside of which a low-tack adhesive 20 is arranged.

The prescoring can be produced for example by a preliminary die-cutting operation (discontinuous incision).

The expression "low-tack adhesive" is understood to reference an adhesive that allows to join and separate several times two surfaces before the adhesive effect is lost.

The fourth side of the preset portion or region 18 substantially corresponds, in this case, to the line 21 along which the wing 16 folds with respect to the wall 15.

As regards operation, the first lifting of the wing 16 tears the preset portion 18 of the wall 15 and opens a hole 22 for accessing the container 10.

The low-tack adhesive 20 ensures successive repeated opening and closure actions.

As an alternative, the portion 18 of the wall 15 can also be omitted due to a die-cutting operation (continuous incision).

In this case, a quadrangular hole is formed directly in the wall and a low-tack adhesive is arranged on its outside on three sides.

The first lifting of the wing 16 causes the opening of the hole, which can be equivalent to the hole designated by the reference numeral 22 in the preceding case, for accessing the container 10.

The low-tack adhesive ensures successive repeated opening and closure actions.

In practice it has been found that the flexible container according to the invention achieves the intended aim and objects.

In particular, the flexible container according to the invention ensures easier opening for accessing the products and the possibility to reclose it in order to retain the unused products inside it.

The opening and reclosure actions can be performed until the contained products are fully used up.

It is also evident that the flexible container according to the invention can be manufactured without using manufacturing techniques that are particular with respect to known ones.

Another advantage is that the flexible container according to the invention has an extremely simple constructive structure.

It is also evident that the flexible container according to the invention can be manufactured with an automated procedure.

Another advantage is that the container according to the invention can be manufactured with very low manufacturing and production costs.

The invention thus conceived is susceptible of numerous modifications and variations, all of which are within the scope of the appended claims.

All the details may further be replaced with other technically equivalent ones.

In practice, the materials employed, so long as they are compatible with the contingent use, as well as the dimensions, may be any according to requirements.

The disclosures in Italian Patent Application No. PD2002A000141 from which this application claims priority are incorporated herein by reference.

What is claimed is:

1. A flexible container derived from a contoured tubular body, formed by a film with a longitudinal heat-seal and with transverse heat-seals at two opposite ends thereof, comprising: a longitudinal wing with an edge thereof formed by the longitudinal heat-seal, that is folded along a folding line against a corresponding wall of said body, a portion of said wing being joined to a corresponding portion of said corresponding wall; a hole for accessing the container; a low-tack adhesive for joining said wing corresponding wall portions to each other and provided so as to surround a region preset to form said hole, and wherein a first lifting of said wing opens said hole and therefore the container, said low-tack adhesive being of a type that provides for successive repeated openings and closures of said wing.

2. The container of claim 1, further comprising a prescoring line adapted to form said hole, said portion of said wing being rigidly coupled to said corresponding portion of the wall, said prescoring line forming a contour that surrounds at least partially said corresponding wall portion, and said low-tack adhesive being arranged at said corresponding wall portion, outside of said prescoring line contour, a first lifting of said wing tearing said corresponding wall portion and opening said hole of the container.

3. The container of claim 1, wherein said portion of said wing is coupled to said corresponding portion of the wall that surrounds said hole, said low-tack adhesive being placed in a region of said corresponding wall portion that surrounds said hole, a first lifting of said wing opening said hole of the container.

4. The container of claim 2, wherein said portion of said wing is coupled to said corresponding wall portion in said region preset to form said hole for accessing the container by sealing means, preferably selected from adhesive, and heat-sealing means.

5. The container of claim 2, wherein said prescoring line is a preliminary die-cut.

6. The container of claim 1, wherein said longitudinal heat-seal is provided only at an outermost region of said longitudinal wing.

7. The container of claim 1, wherein said corresponding wall portion that surrounds said region preset to form the hole for accessing the container has a substantially quadrangular shape and is surrounded on three sides by said low-tack adhesive, a fourth side thereof corresponding to the folding line of said longitudinal wing with respect to the corresponding wall of said body.

* * * * *